US007592543B2

(12) United States Patent
Caveney et al.

(10) Patent No.: US 7,592,543 B2
(45) Date of Patent: Sep. 22, 2009

(54) WALL MOUNTED ENCLOSURE WITH ROTATING PATCH PANEL FRAME

(75) Inventors: Jack E. Caveney, Hinsdale, IL (US); Dale A. Block, Schererville, IN (US); Scott M. Lesniak, Lockport, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/264,373

(22) Filed: Nov. 4, 2008

(65) Prior Publication Data

US 2009/0086463 A1 Apr. 2, 2009

Related U.S. Application Data

(63) Continuation of application No. 11/530,177, filed on Sep. 8, 2006, now Pat. No. 7,462,779.

(60) Provisional application No. 60/714,997, filed on Sep. 8, 2005.

(51) Int. Cl.
*H01B 3/00* (2006.01)

(52) U.S. Cl. ..... 174/68.1; 174/47; 174/481; 174/480; 174/68.3; 174/135; 439/207; 385/135; 248/68.1

(58) Field of Classification Search ..... 174/47, 174/70 C, 68.1, 68.3, 135, 100, 21 R, 24, 174/69; 361/608, 826; 385/135; 439/207, 439/244, 451; 52/220.7; 248/205.1, 74.3, 248/230.8, 68.1

See application file for complete search history.

(56) References Cited

U.S. PATENT DOCUMENTS 4,516,818 A 5/1985 Johnston et al.
5,115,862 A * 5/1992 Hastings ..... 166/65.1
5,367,598 A 11/1994 Devenish, III et al.
5,568,362 A 10/1996 Hansson
5,708,751 A 1/1998 Mattei
5,734,776 A 3/1998 Puetz
5,902,961 A 5/1999 Viklund et al.
5,940,937 A 8/1999 Churchill et al.
6,385,381 B1 5/2002 Janus et al.
6,408,579 B1 * 6/2002 Anderson et al. ..... 52/220.7
6,424,781 B1 7/2002 Puetz et al.
6,427,952 B2 8/2002 Caveney et al.
6,535,682 B1 3/2003 Puetz et al.
6,556,763 B1 4/2003 Puetz et al.
6,710,244 B1 * 3/2004 Pferschy ..... 174/666
6,711,339 B2 3/2004 Puetz et al.
6,759,589 B1 * 7/2004 VanderVelde ..... 174/481
6,760,531 B1 7/2004 Solheid et al.
6,818,834 B1 * 11/2004 Lin ..... 174/135
7,132,600 B2 * 11/2006 Kaneko ..... 174/480
7,345,239 B2 * 3/2008 Tousignant et al. ..... 174/68.1
7,359,218 B2 * 4/2008 McGrew ..... 361/826
7,456,357 B1 * 11/2008 Kwong et al. ..... 174/58
2005/0179348 A1 8/2005 Caveney et al.

* cited by examiner

*Primary Examiner*—Dhiru R Patel
(74) *Attorney, Agent, or Firm*—Robert A. McCann; Christopher S. Clancy; James H. Williams

(57) ABSTRACT

An apparatus for mounting electrical equipment includes a frame for carrying electrical equipment, a hinge connected to the frame, and a cable ring connected to the hinge. The cable ring is positioned between the frame and an axis of rotation of the hinge.

10 Claims, 14 Drawing Sheets

WALL MOUNTED ENCLOSURE WITH ROTATING PATCH PANEL FRAME

CROSS-REFERENCE TO RELATED APPLICATIONS

This application is a continuation of U.S. Ser. No. 11/530,177, filed Sep. 8, 2006, now U.S. Pat. No. 7,462,779, which claims priority to Provisional Application Ser. No. 60/714,997, filed Sep. 8, 2005, the entirety of which is hereby incorporated by reference.

FIELD OF INVENTION

This invention relates to an apparatus for housing electrical cable connections and, more particularly, to an apparatus which contains a patch panel for electrical cable connections.

BACKGROUND

Buildings, in particular office buildings, which utilize various telecommunications systems, computer networks or employ building operational systems, such as fire monitoring, surveillance or HVAC systems, often rely on intricate pathworks of cables to interconnect the components within these systems and networks. Appropriate interconnection of cables locally (e.g., within the building) provide, for example, an ethernet, telephone system or a building-wide operational system. In addition, some or all of these local systems and networks may need to be connected to a wider outside network or system such as to the Internet or the worldwide telecommunications network.

Patch panels may be employed to provide ease in installing and modifying cable connections within these local systems or networks and likewise to connect the local networks and systems to the outside wider networks. Patch panels can receive cables that are connected to components within a zone of the local system or network (e.g., personal computers or telephones) and, in turn, connect those cables through the patch panel to outgoing cables. The outgoing cables may connect, for example, to a more centralized system such as a telecommunications closet. The telecommunications closet will then, in turn, interconnect the components within the local system and even connect local components to an outside broader network or system.

Patch panels have been mounted to a wall to provide cable connections for a zone within a local network within a building. These patch panels have been mounted to a hinge to swing one end of the patch panel away from the wall in order for the installer or maintenance personnel to access cables secured to the front and back of the patch panel in the process of installation of cable connections or modification of existing cable connections.

There is a need, however, to efficiently install or modify cable connections and to provide a secure environment for the cable connections within a building environment.

SUMMARY OF THE INVENTION

The present invention relates to an apparatus for housing a patch panel for electrical cable connections.

In one embodiment, an apparatus for mounting electrical equipment comprises a frame for carrying electrical equipment, a hinge connected to the frame, and a cable ring connected to the hinge. The cable ring is positioned between the frame and an axis of rotation of the hinge.

In another embodiment, an apparatus for mounting electrical equipment comprises a cable ring having a movable portion and a fixed portion and a frame for carrying electrical equipment connected to the movable portion of the cable ring. The movable portion of the cable ring is movable about an axis of rotation such that the frame is also movable about the axis of rotation.

BRIEF DESCRIPTION OF DRAWINGS

Certain embodiments of the present invention are illustrated by the accompanying figures. It should be understood that the figures are not necessarily to scale and that details that are not necessary for an understanding of the invention or that render other details difficult to perceive may be omitted. It should be understood, of course, that the invention is not necessarily limited to the particular embodiments illustrated herein.

DETAILED DESCRIPTION

The present invention relates to an apparatus for housing and containing cable connections made with electrical equipment such as a patch panel. Typically, the apparatus is capable of being mounted to a wall within a building and therefore can be easily positioned proximate to a zone of a local system or network within the building.

Figure 2:
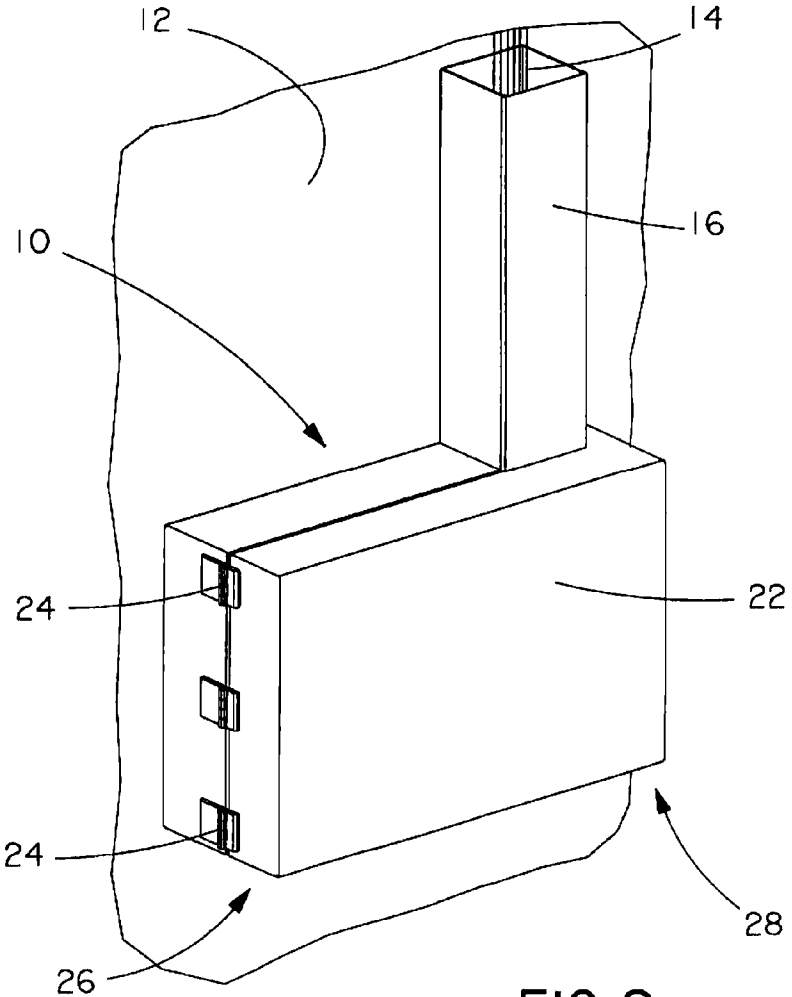
FIG. 2 is a perspective view of FIG. 1, showing the hinges connecting the door to the enclosure.
Figure 1:
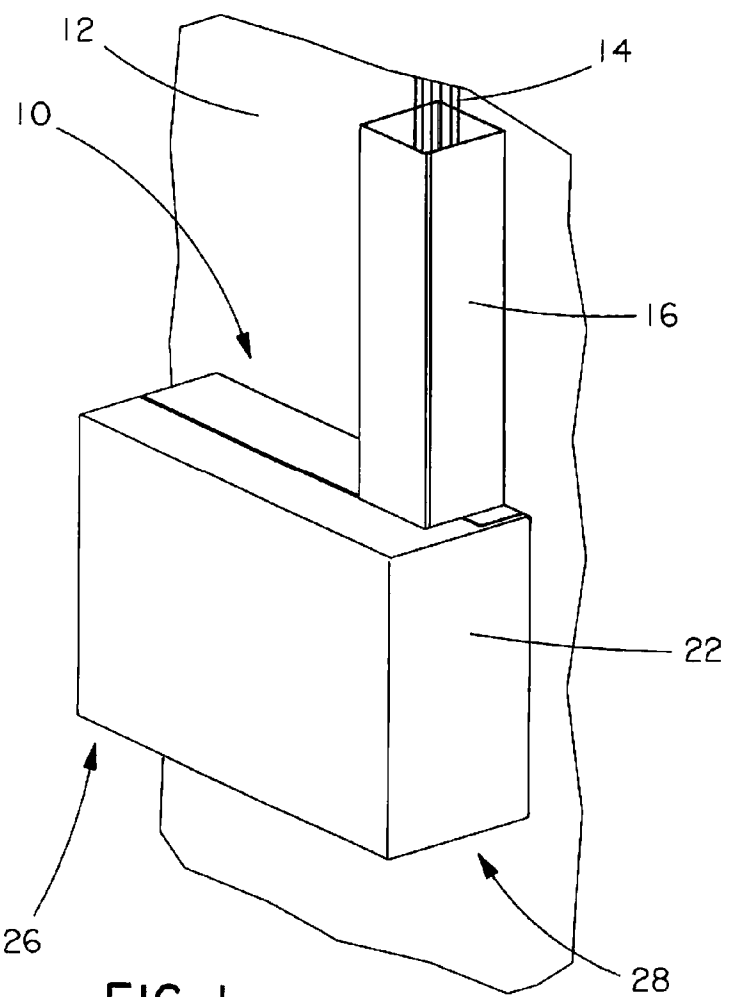
FIG. 1 is a perspective view of one embodiment of the apparatus of the present invention.

Referring now to FIGS. 1-4, one embodiment of the invention includes enclosure 10, such as a cabinet, for housing cable connections such as those made with a patch panel. Enclosure 10 can be mounted directly to a wall 12 through use of conventional means, including bolts or screws, which secure, for example, a back wall of enclosure 10 to wall 12. Numerous other ways of securing enclosure 10 include utilizing a frame that engages enclosure 10 and, in turn, is secured to wall 12. As shown in FIGS. 1 and 2, cables 14 typically enter and exit enclosure 10 through openings provided by enclosure 10 which, in turn, communicate with conduits or raceways 16.

Figure 3:
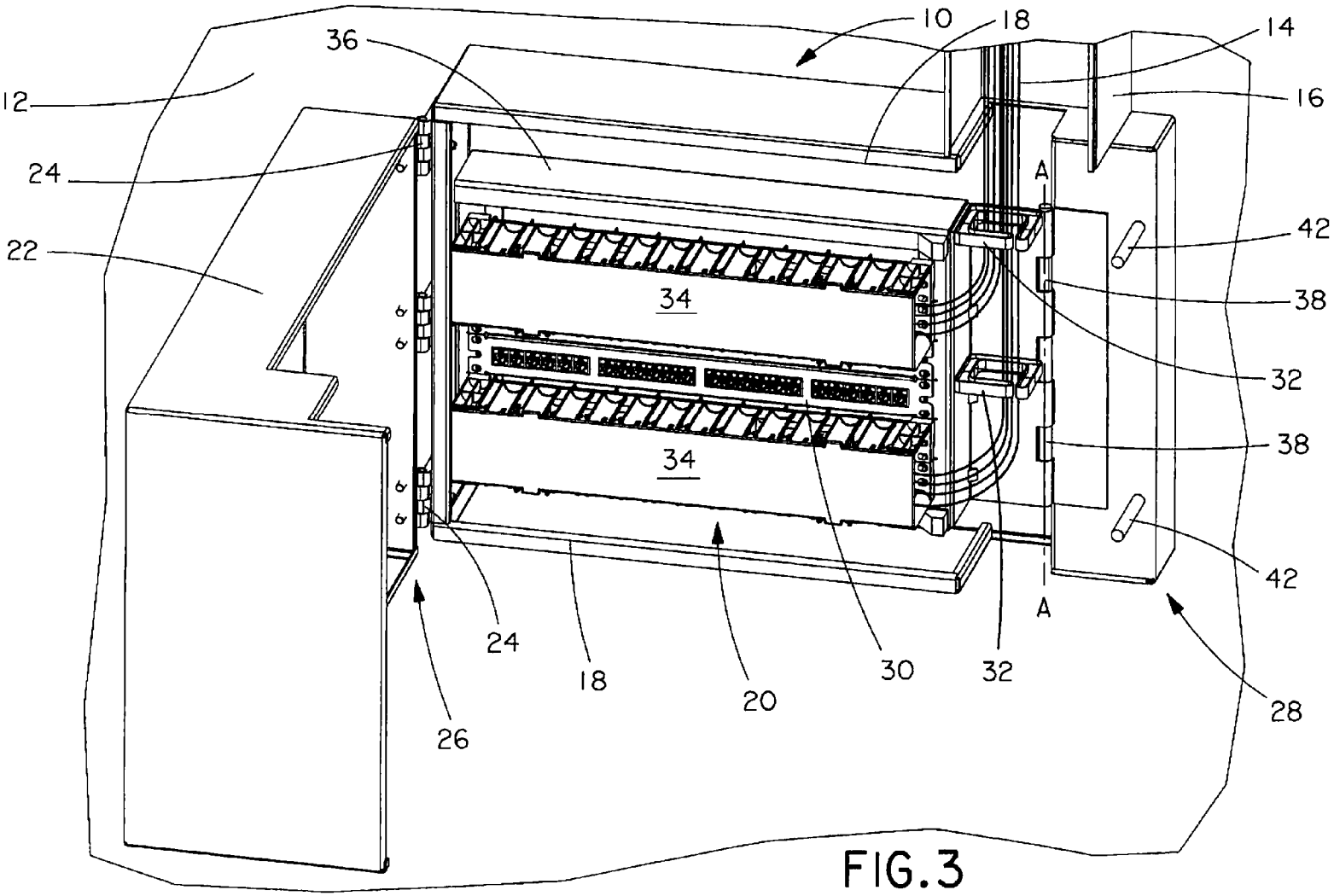
FIG. 3 is a front perspective view of FIG. 1, with the door partially opened.
Figure 4:
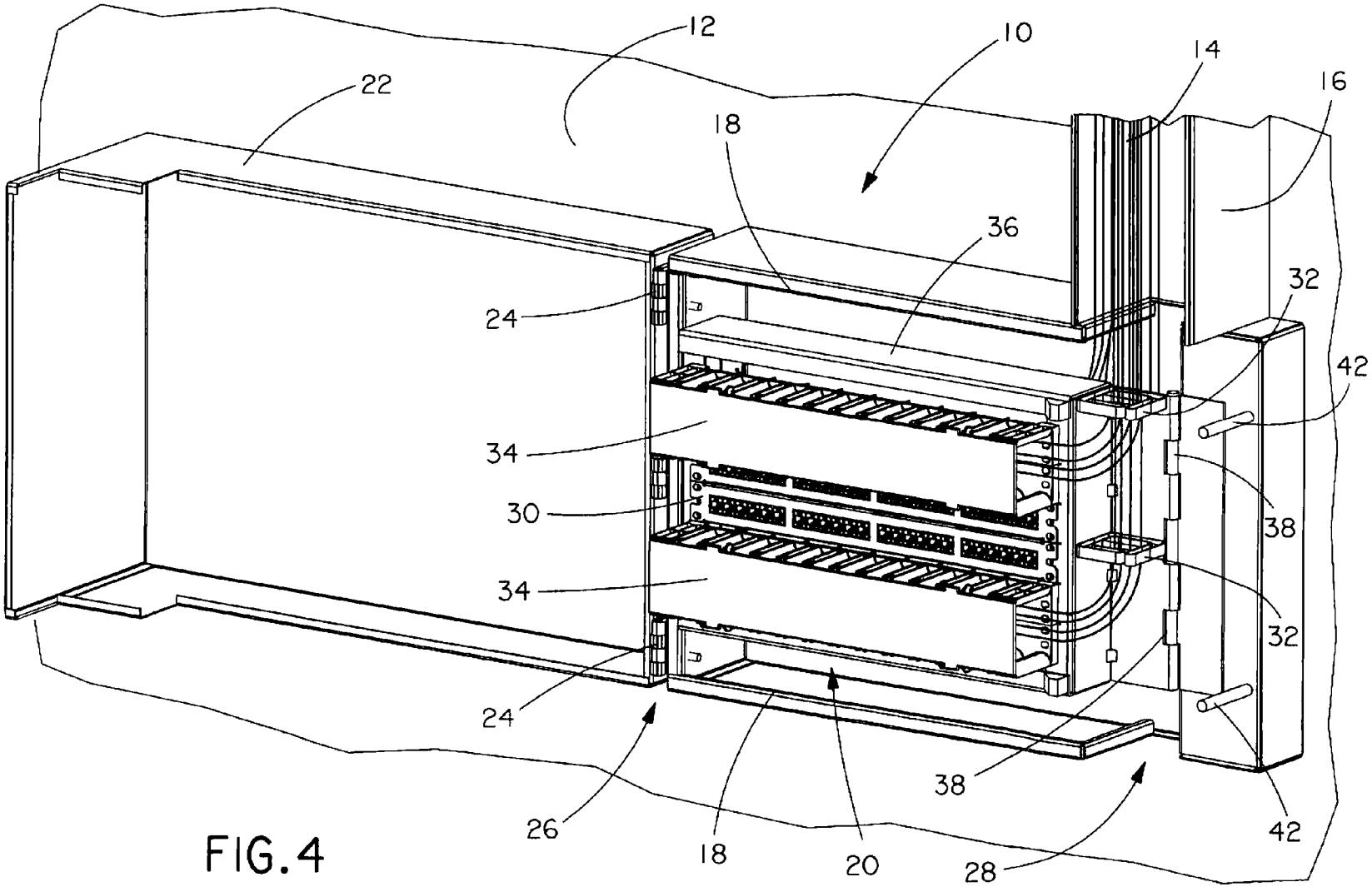
FIG. 4 is a front perspective view of FIG. 1, with the door fully opened.

Now referring to FIGS. 3 and 4, enclosure 10 defines an opening 18 to access interior 20 of enclosure 10. Door 22 is connected to enclosure 10 with hinges 24 permitting door 22 to open and close opening 18 as seen in FIGS. 2-4. With door 22 in a closed position, as seen in FIG. 2, cable connections may be protected from dirt and dust, as well as other undesirable materials that may be present within a building environment. Likewise, the connections within enclosure 10 can be secured from unauthorized individuals to prevent their access to cable connections contained therein.

In referring to FIGS. 3 and 4, door 22 can be connected by hinges 24 from a left side 26 or right side 28 (hinges mounted on this side not shown) of enclosure 10. The versatility of providing hinges 24 on either side of enclosure 10 provides the installer the opportunity to select the best hinge position or location for the particular installation of enclosure 10. With door 22 swinging away from interior 20 in order to access interior 20, an installer would select an enclosure 10 with a particular hinging arrangement for door 22 to give the installer the easiest and least obstructed access to interior 20. For example, the installer would likely select hinges 24 to be positioned on a side of enclosure 10 having greater clearance for door 22 to swing open. As seen in FIG. 3, door 22 may swing out approximately 90 degrees from its closed position if, for example, a wall is running perpendicular to wall 12 and adjacent to enclosure 10. On the other hand, in FIG. 4, there appears to be no obstructions to left side 26 of enclosure 10 and door 22 is permitted to swing open approximately 180 degrees from its closed position. Typically, the installer would select the hinge location to be on the side of enclosure 10 that would allow door 22 the most freedom to travel without obstruction in swinging out and away from interior 20 of enclosure 10 and thereby provide the optimal access to interior 20.

In accessing interior 20 of enclosure 10, the installer works with cable connections associated with the front and rear portions of patch panel 30, shown in FIGS. 3 and 4. Cables 14 that are entering or exiting enclosure 10 by way of raceway 16 typically are threaded through openings in at least one or more cable rings 32, such as D-rings, and are often thereafter passed through cable managers 34. Patch panel 30 is mounted to frame 36 which is, in turn, rotatably connected to enclosure 10 with hinges 38, which rotate about axis of rotation A. Cable managers 34 are often likewise mounted to frame 36 and positioned on either side of patch panel 30 to provide needed separation and organization of cables 14 that are connected to patch panel 30. With this construction, the installer can access the front and rear portions of patch panel 30, when installing or modifying cable connections on patch panel 30.

Figure 5:
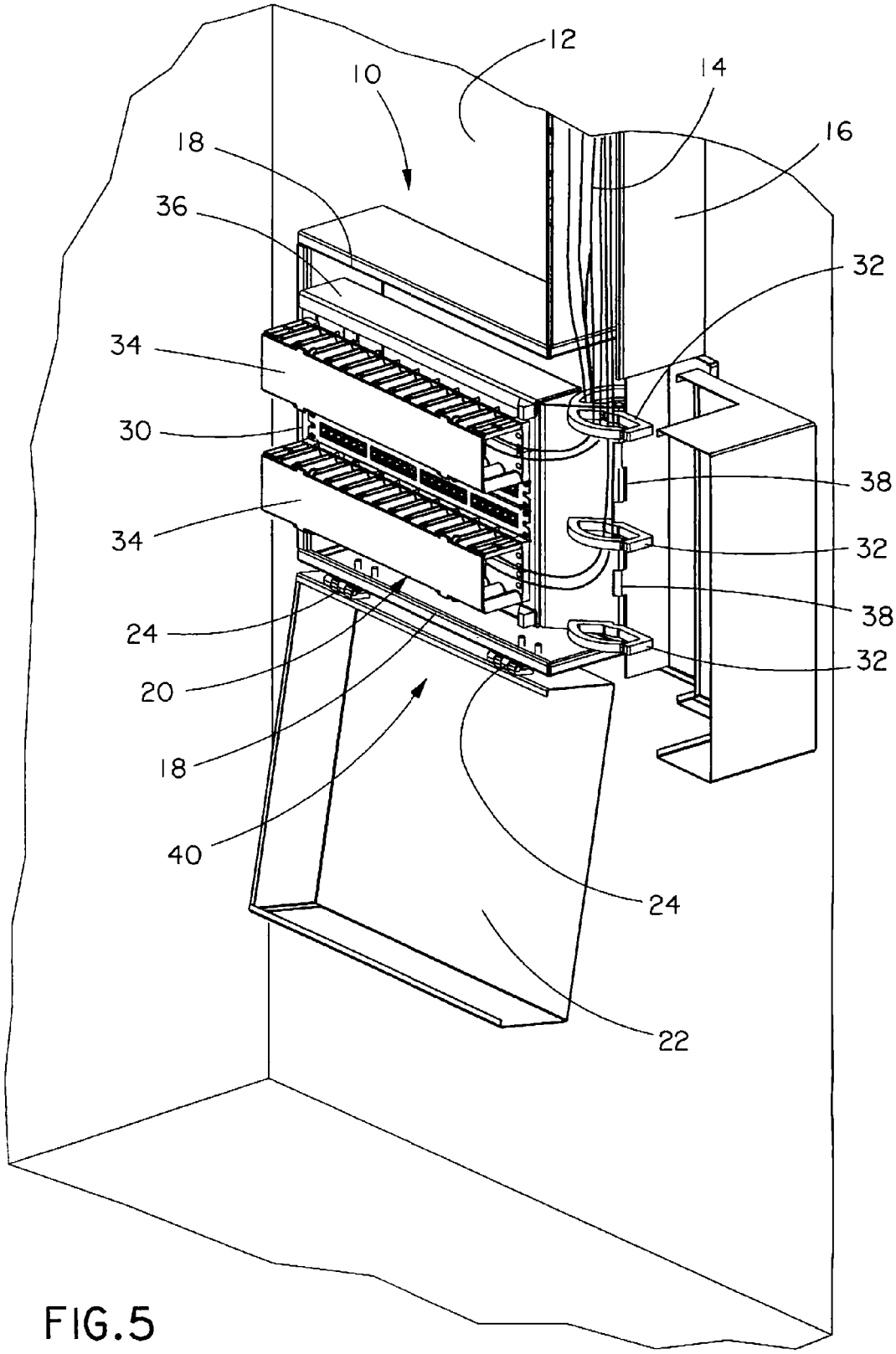
FIG. 5 is a perspective view of a second embodiment of the apparatus of the present invention.

An alternative or second embodiment of the invention shown in FIGS. 1-4 is shown in FIG. 5. In this embodiment, door 22 is mounted to enclosure 10 with hinges 24, whereby door 22 swings open and away from interior 20 in a direction toward bottom side 40 of enclosure 10.

Figure 6:
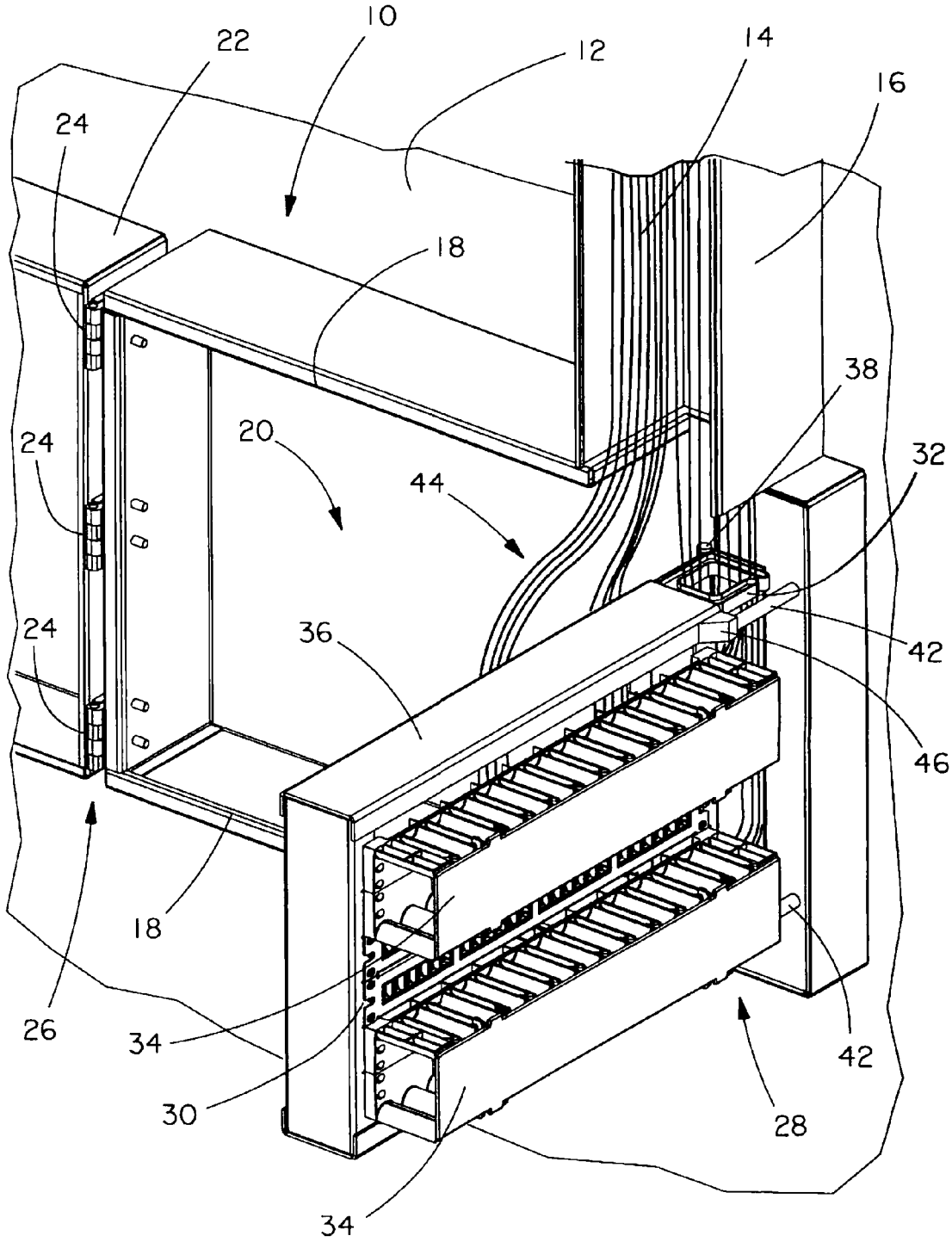
FIG. 6 is a front perspective view of a third embodiment of the apparatus of the present invention.
Figure 7:
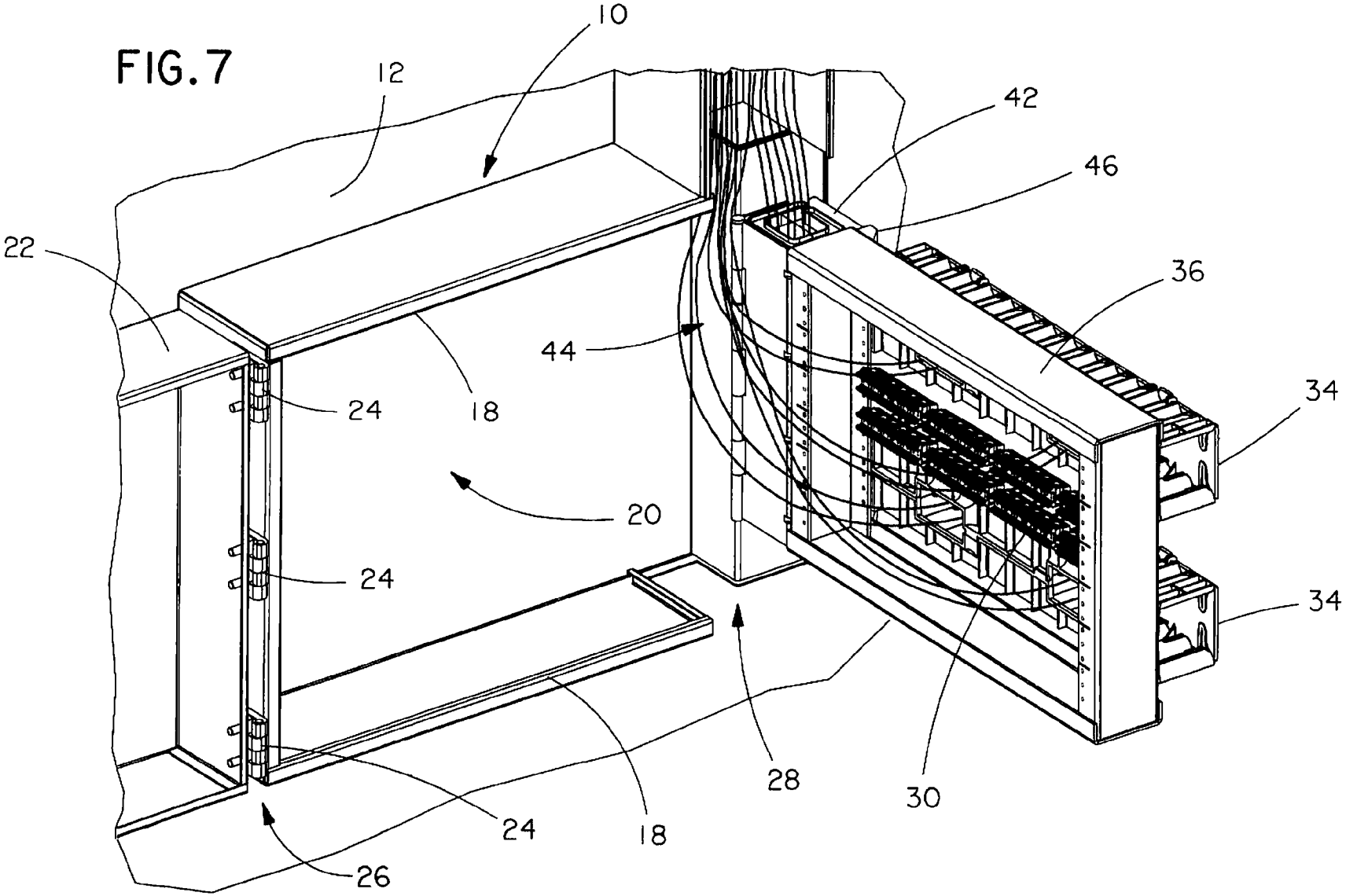
FIG. 7 is a front perspective view of FIG. 6, wherein the back of the frame carrying the patch panel is shown.

Referring now to FIGS. 6 and 7, a third embodiment of the present invention is shown. A stop member or projection 42 is connected to and extends from enclosure 10. Stop member 42 is positioned within a path of rotation 44 of frame 36 which carries patch panel 30. In this embodiment, stop member 42 is aligned with an abutment member 46 mounted to frame 36. With frame 36 being rotated by an installer to access the rear side of patch panel 30, as shown in FIGS. 6 and 7, stop member 42 comes into contact with abutment member 46 stopping frame 36 from further rotation relative to enclosure 10. In this way, frame 36 will be prevented from overrotating and damaging frame 36, cable manager 34, patch panel 30 and cable 14 connections.

Figure 8:
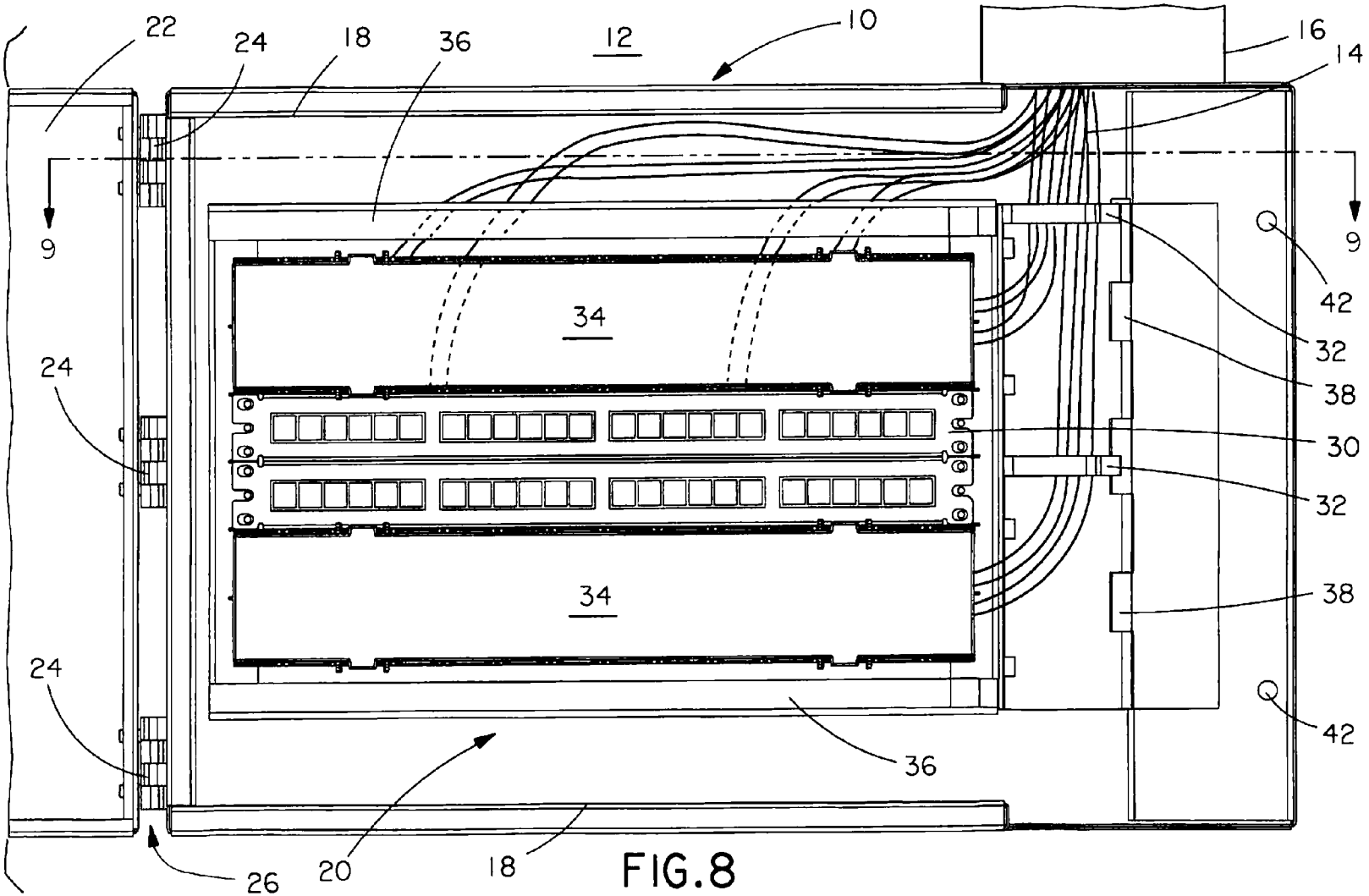
FIG. 8 is a front elevation view of a fourth embodiment of the apparatus of the present invention.
Figure 9:
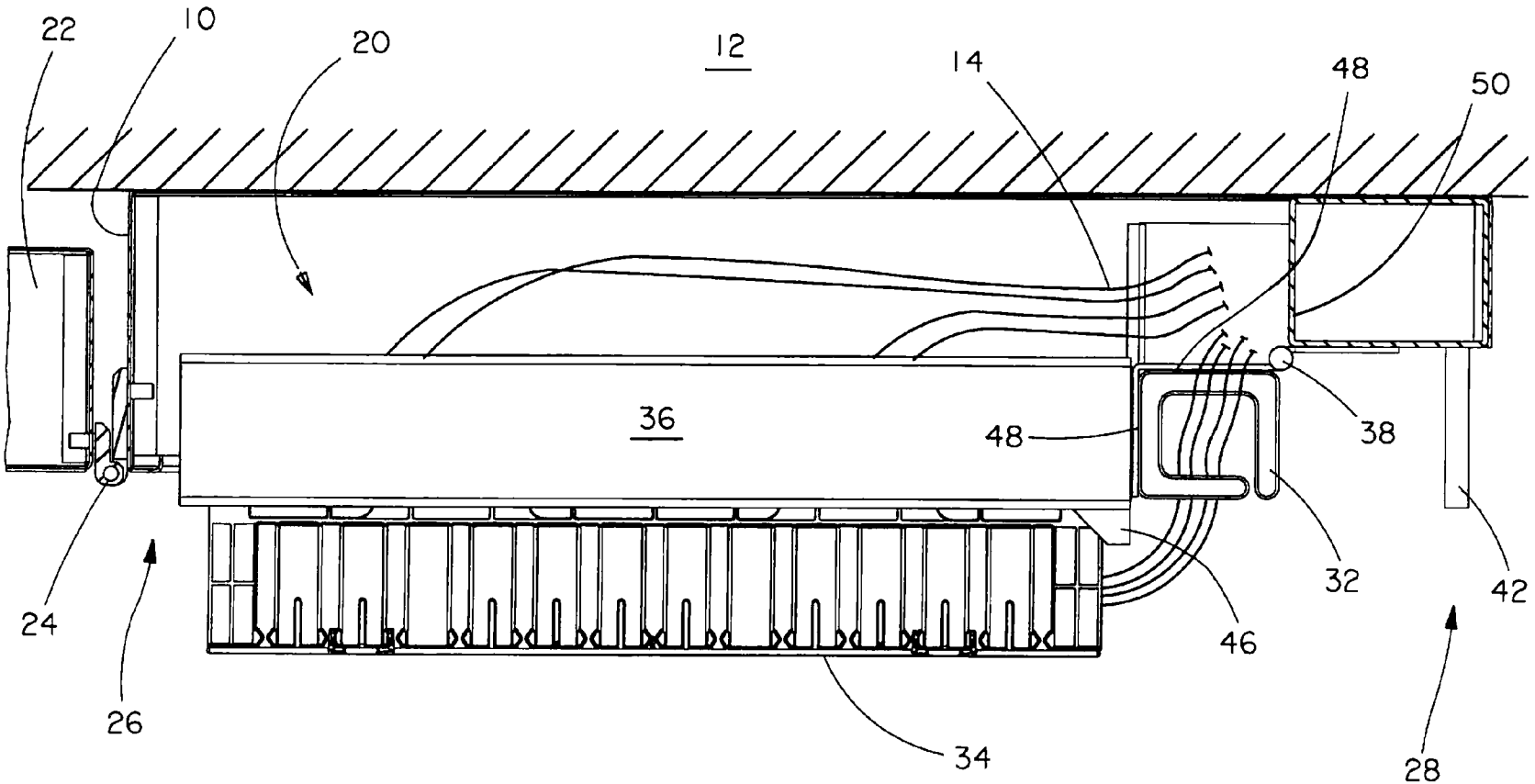
FIG. 9 is a partial top plan view of FIG. 8 along line 9-9 of FIG. 8.
Figure 10:
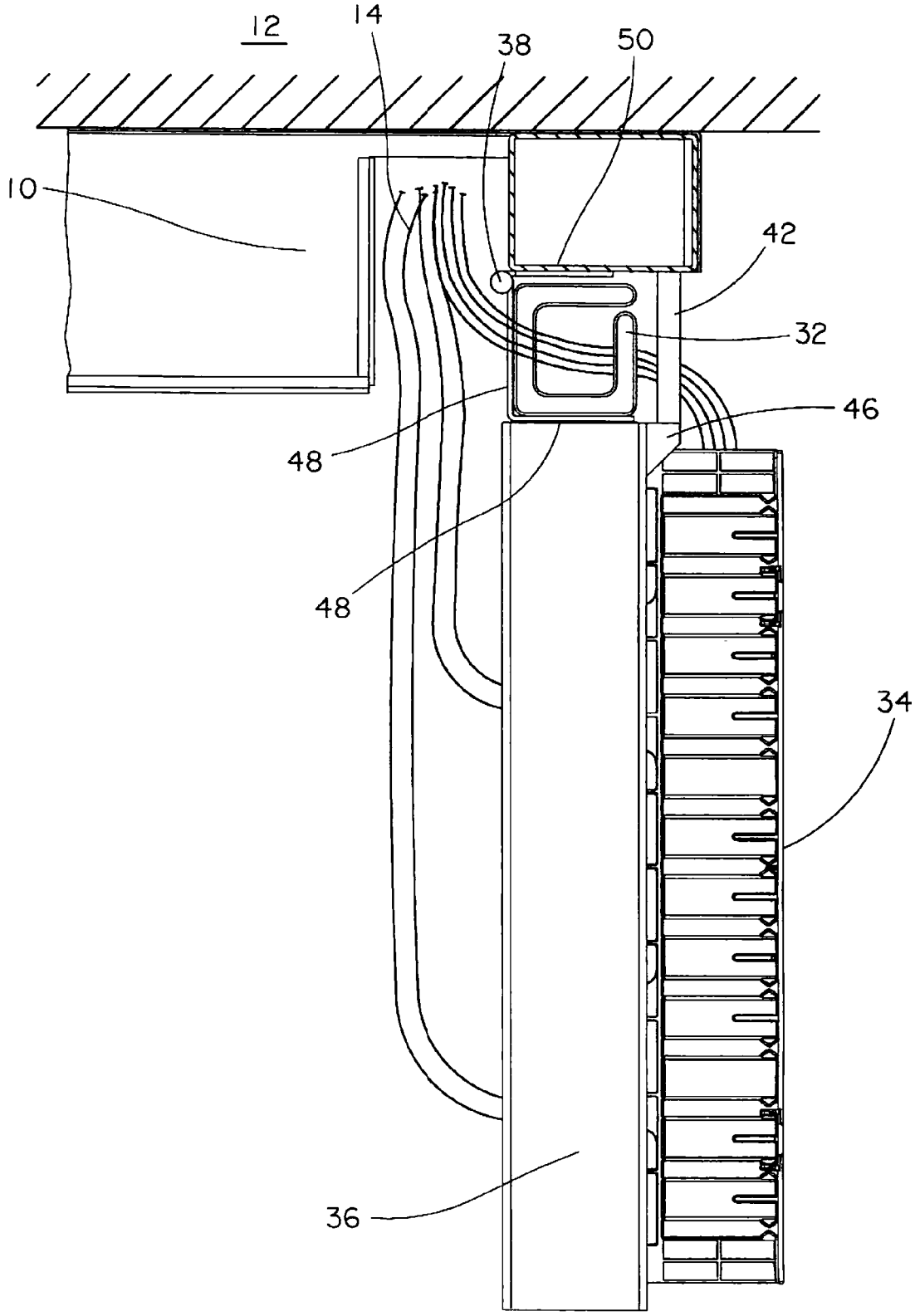
FIG. 10 is a partial top plan view of FIG. 9, with the patch panel rotated relative to the enclosure.

Referring to FIGS. 8-10, a fourth embodiment of the present invention is shown. Frame 36 which carries, and is connected to, patch panel 30 is positioned in interior 20 of enclosure 10, as seen in FIG. 8. Frame 36 is connected to bracket 48 which, in turn, is connected to hinge 38 which, in turn, is connected to wall member 50, seen in FIGS. 9 and 10. Wall member 50 may be a portion of enclosure 10 or portion of any wall, such as a wall within a building. Similarly, cable ring 32 is connected to hinge 38. Cable ring 32 is positioned between frame 36 and hinge 38. With cable ring 32 secured to at least one of bracket 48 and frame 36, cable ring 32 moves as a unit with frame 36 and patch panel 30, as frame 36 rotates about hinge 38. With this construction, a separation or increase in distance between patch panel 30 carried by frame 36 and cable ring 32 is minimized during rotation of patch panel 30. As a result, an installer does not have to provide additional length of cable 14 or slack to reside in enclosure 10 to accommodate the rotation of frame 36 to access the rear portion of patch panel 30.

Figure 11:
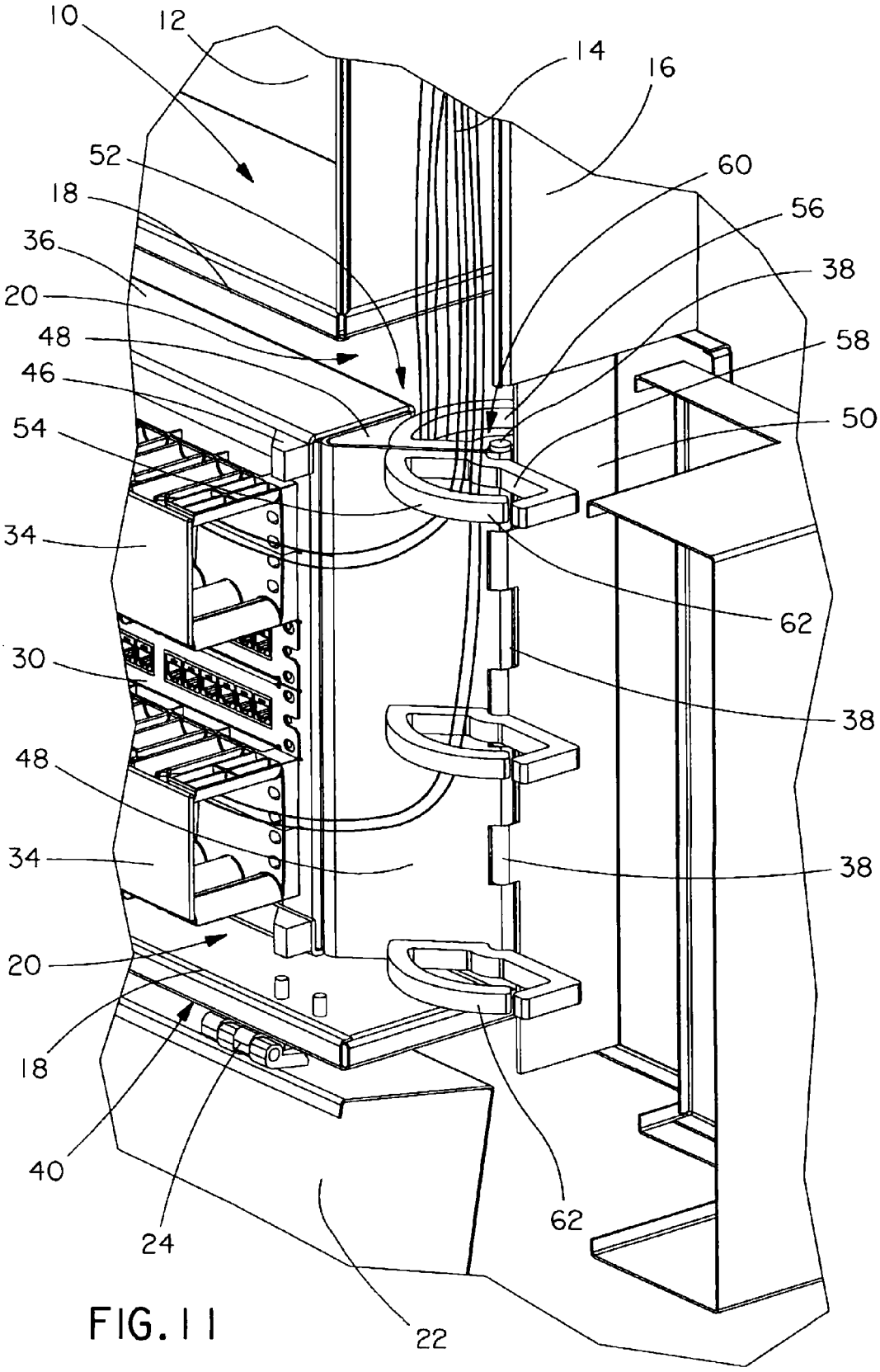
FIG. 11 is a partial front perspective view of a fifth embodiment of the apparatus of the present invention.
Figure 12:
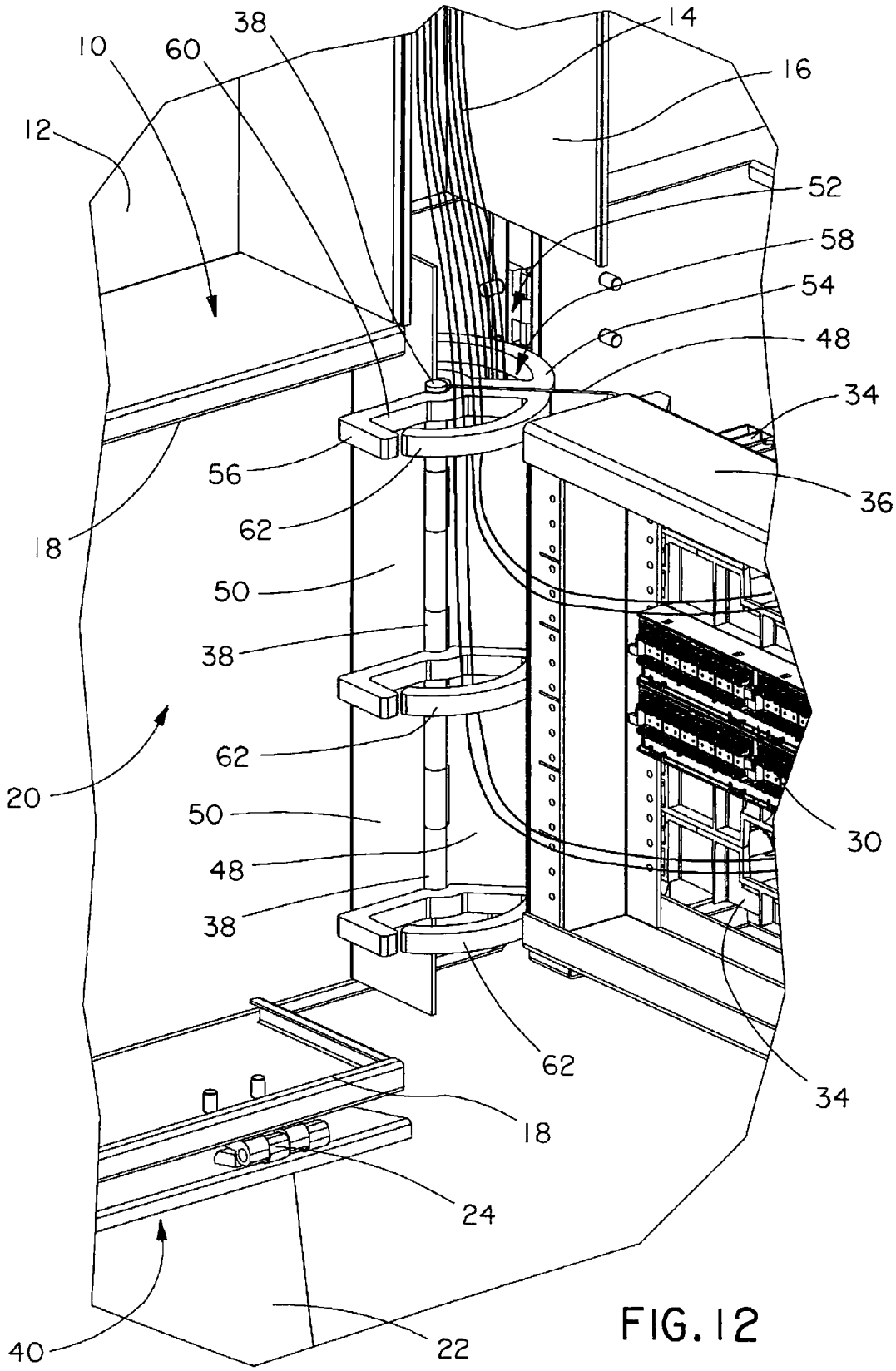
FIG. 12 is a partial front perspective view of FIG. 11, with the patch panel in a rotated position.

Referring now to FIGS. 11 and 12, a fifth embodiment is shown. A cable ring apparatus 52 providing two openings is connected to wall member 50. As described above, wall member 50 can be a portion of enclosure 10 or a portion of any wall within a building. In the embodiment shown, cable ring apparatus 52 is two separate cable rings 54 and 56, wherein each cable ring is positioned on opposing sides of bracket 48. Each of cable rings 54 and 56 define openings 58 and 60, respectively. Cable rings 54 and 56 can take on known cable ring constructions and, in this example, the cable rings are constructed as disclosed in U.S. Pat. No. 6,427,952, issued to Panduit Corp. on Aug. 6, 2002. In this example, a portion 62 of each cable ring can be turned away from its undistorted position (undistorted position is shown in FIGS. 11 and 12) and cables 14 can either be inserted or removed from the cable ring as desired. It is also contemplated that cable ring apparatus 52 can be a single construction (not shown), wherein a single cable ring is provided with at least two openings defined in the apparatus with, for example, a member positioned to separate the opening in the cable ring into at least two openings.

Typically, each of openings 58 and 60 are positioned proximate to the front and rear, respectively, of frame 36 and patch panel 30. Thus, with a large number of cables 14 to handle, an installer can segregate the cables into the proper opening 58 or 60, depending on whether the cable is to be connected to the front or the rear of patch panel 30.

In this embodiment, cable ring apparatus 52 is positioned between frame 36 and the location where frame 36 is connected to wall member 50. Frame 36 is connected to wall member 50 with hinge 38 through bracket 48. Cable ring apparatus 52 is also connected to wall member 50 with hinge 38. In the present embodiment, cable ring apparatus 52 is connected to frame 36 through bracket 48. As a result, cable ring apparatus 52 rotates about hinge 38 as a unit with frame 36 and patch panel 30. Again, because of the construction of this embodiment, the need for excessive length of cable 14 or slack is diminished.

Figure 13:
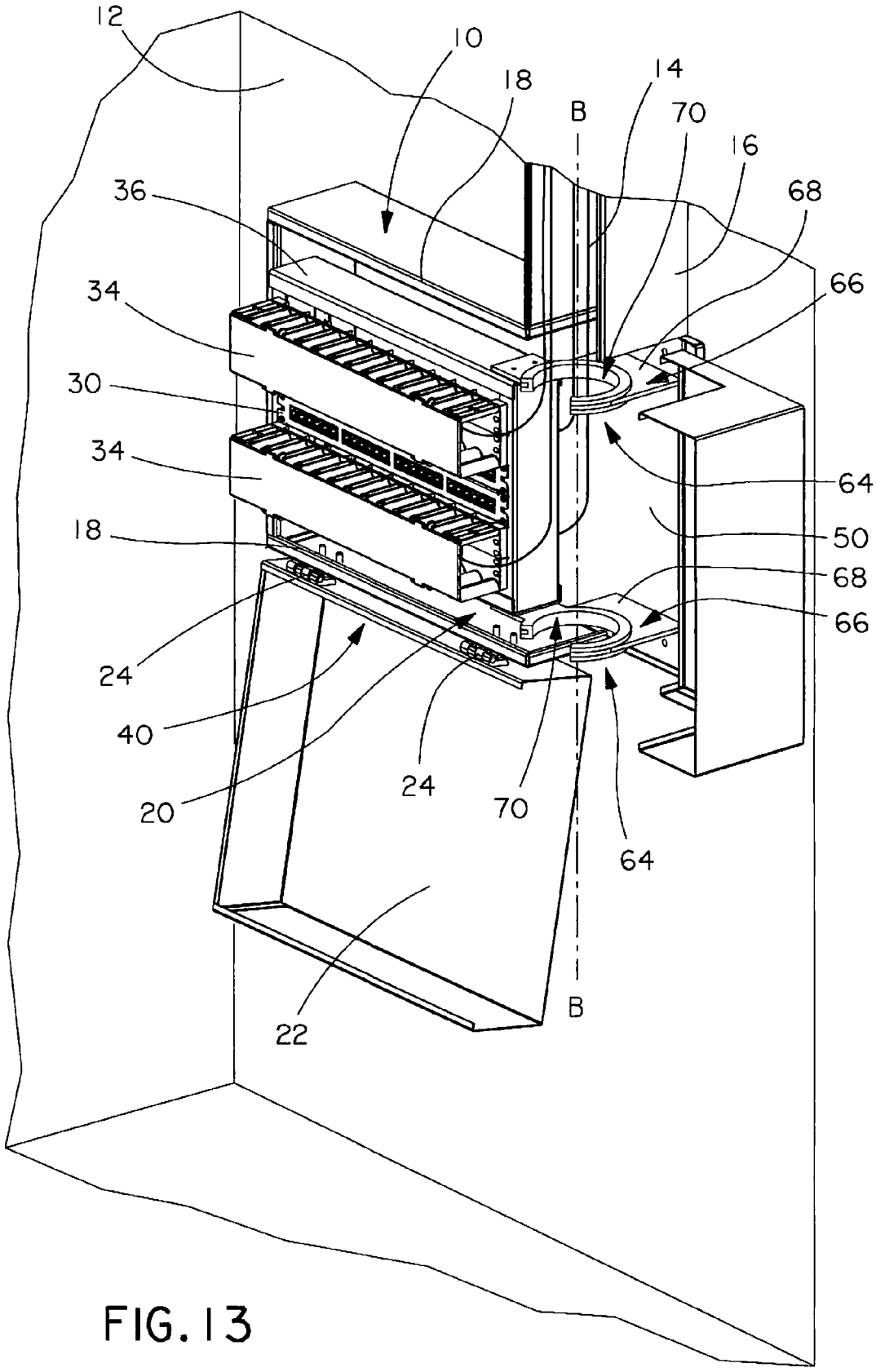
FIG. 13 is a front perspective view of a sixth embodiment of the present invention.
Figure 14:
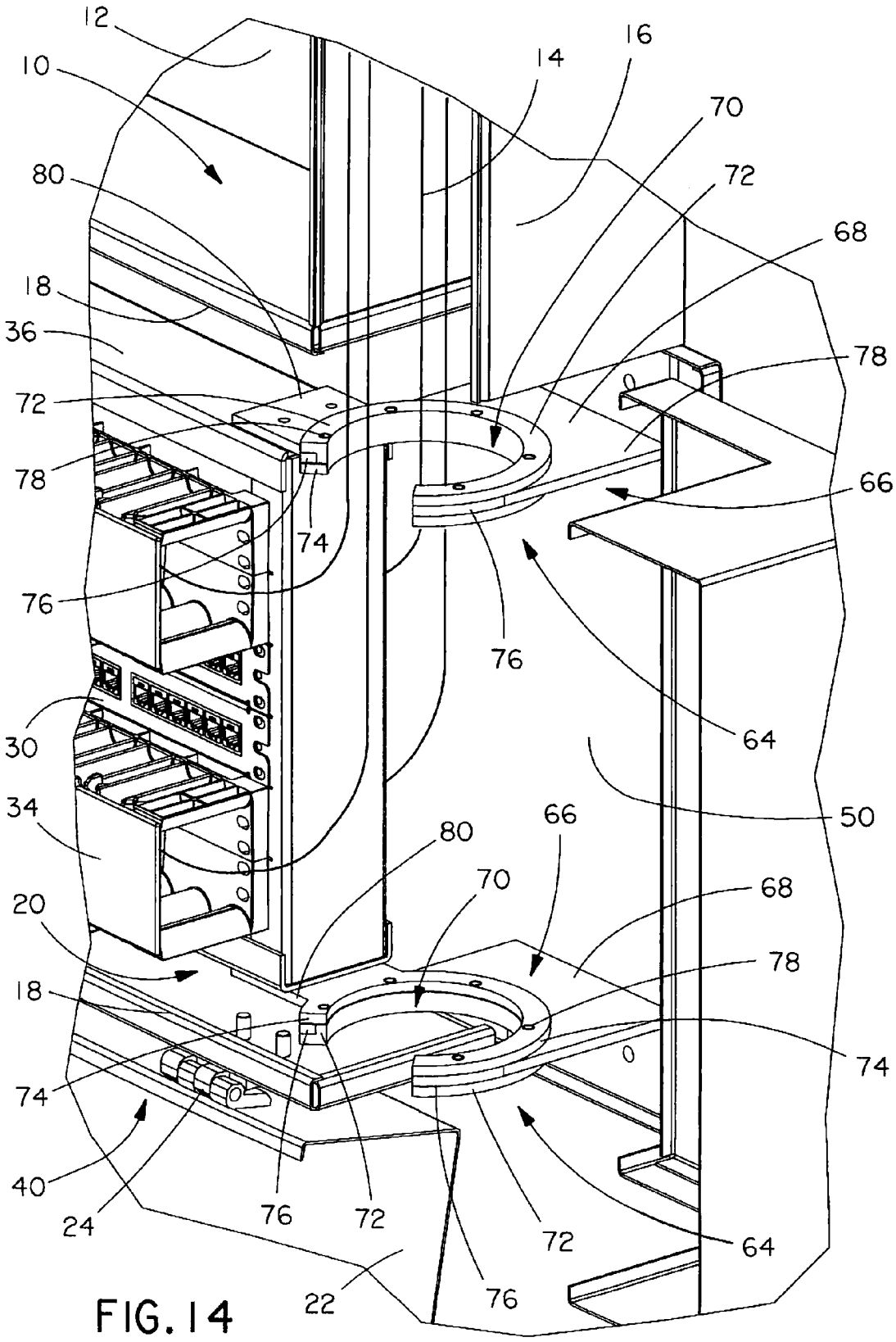
FIG. 14 is an enlarged partial front perspective view of FIG. 13.
Figure 15:
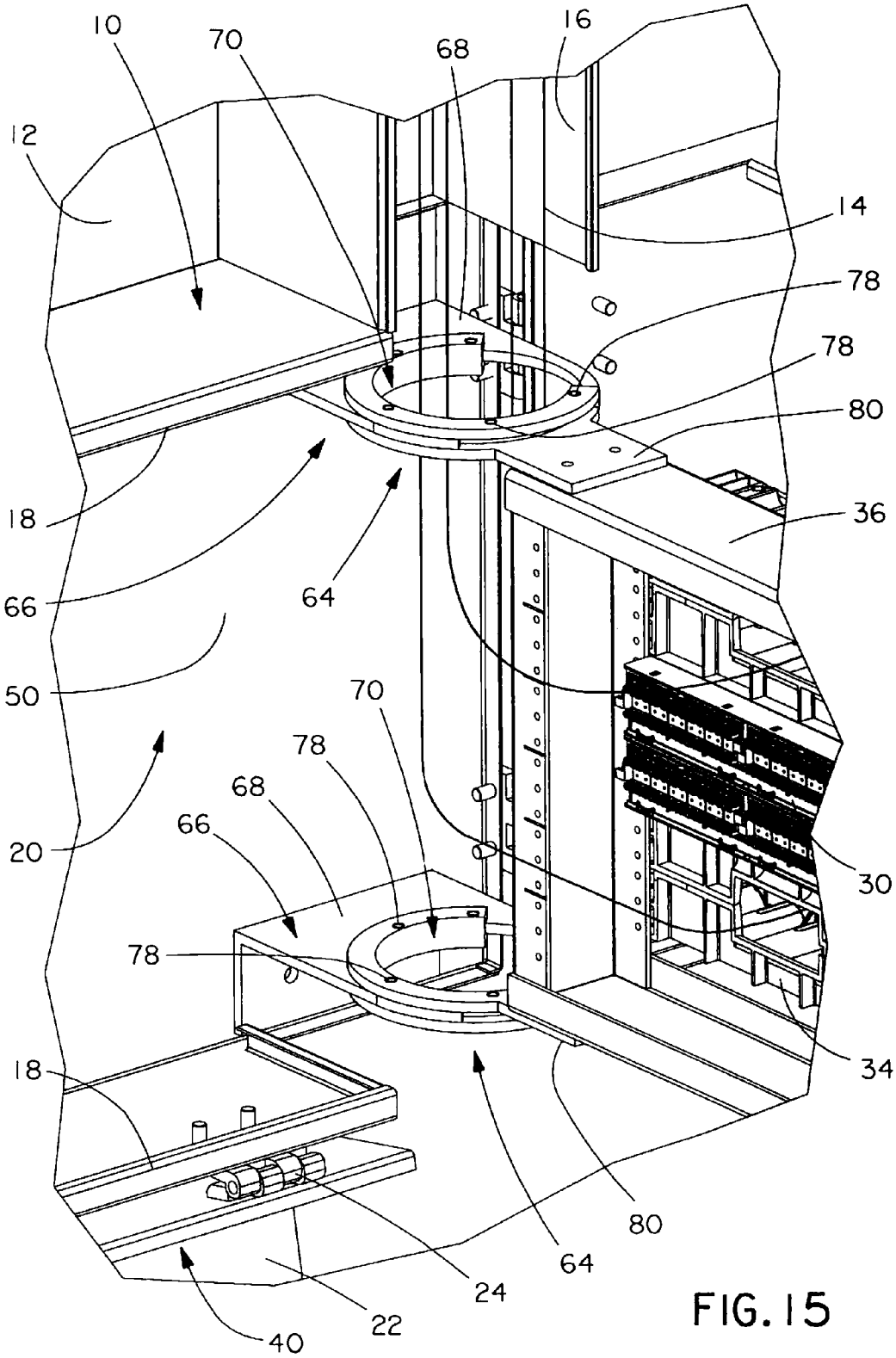
FIG. 15 is an enlarged partial front perspective view of FIG. 13, with the patch panel in a rotated position.

Referring to FIGS. 13-15, a sixth embodiment of the present invention is shown. Cable ring 64 includes a fixed portion 66 connected to wall member 50, wherein fixed portion 66 remains in fixed relationship to enclosure 10. Again, as described above, wall member 50 may be any wall within a building. The embodiment shown in FIGS. 13-15 shows fixed portion 66 including a plate 68 extending away from a sidewall of enclosure 10. Plate 68, in this example, forms a partial circular leading edge (not shown) of approximately 270 degrees. A moveable portion 70 is moveable relative to enclosure 10 and fixed portion 66.

Moveable portion 70, as shown in FIG. 14, comprises an "L" shaped semi-circular annular member 72 and a plate member 74 which is constructed in a semi-circular configuration. Both members 72 and 74 are constructed of a complementary size and shape to mate with one another. In this example, both members 72 and 74 have a semi-circular configuration of approximately 270 degrees.

Each member 72 and 74 is placed on opposing sides of the curved edge of plate 68, forming channel opening 76 to receive the leading semi-circular edge of plate 68. Members 72 and 74 are connected to one another with screws 78, thereby securing moveable portion 70 in sliding relationship with fixed portion 66. The result of this construction permits moveable portion 70 to move in a rotational circular pattern about axis of rotation B.

Frame 36 is connected to moveable portion 70 through plate 80, which can be integrally formed with moveable portion 70, as in this example, or otherwise connected in a number of conventional ways.

In FIG. 14, with frame 36 positioned within interior 20 of enclosure 10, moveable portion 70 is positioned such that cable ring apparatus 64 is in an open position, defining a pathway for the insertion of cable. In this position, the installer can easily move cables in and out of cable ring apparatus 64. In this embodiment, cable ring 64 will also be in an open position with door 22 in a closed position. However, with door 22 closed, door 22 can protect cables 14 from being inappropriately pulled out of cable ring 64.

When the installer chooses to access the rear of patch panel 30, he or she can grasp frame 36 and swing frame 36 out and away from interior 20, as seen in FIG. 15. Moveable portion 70 will slide over fixed portion 66, thereby closing cable ring 64 and closing the pathway for the insertion of cable. In the process of swinging frame 36 on moveable portion 70, rear of patch panel 30 becomes accessible to an installer and opening in cable ring 64 closes confining cables 14.

Cables 14 which are being first installed may be placed through both cable rings 64 seen in FIGS. 13-15. Cables 14 that will be connected to, for example, the rear of patch panel 30 can be lifted from the bottom cable ring 64 with door 22 open and cable ring 64 open. Frame 36 can then be rotated to access the rear of patch panel 30, as seen in FIG. 15, which will cause the opening of cable rings 64 to close. Cable 14 can be cut to an appropriate length and connected to the rear of patch panel 30.

In mounting cable 14 to a front portion of patch panel 30, cable 14 can be lifted out of the bottom cable ring 64 through the opening in cable ring 64 with frame 36 positioned in interior 20 of enclosure 10, as shown in FIGS. 13 and 14. Cable 14 can be cut to an appropriate length and connected to the front portion of patch panel 30.

The configuration of this embodiment which includes frame 36 connected to moveable portion 70 of cable ring 64 permits the installer to provide less overall cable length or slack, since length of cable 14 is not consumed with the rotation of frame 36.

The foregoing description of examples of the invention have been presented for purposes of illustration and description, and are not intended to be exhaustive or to limit the invention to the precise forms disclosed. The examples were selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

The invention claimed is:

1. An apparatus for mounting electrical equipment, the apparatus comprising: an enclosure; a frame rotatably connected to the enclosure, wherein the frame rotates about an axis of rotation from a closed position inside of the enclosure to an open position outside of the enclosure to allow access to electrical equipment mounted on the frame; a bracket connected to the frame, wherein the bracket is positioned between the frame and the axis of rotation; and a cable ring connected to the bracket.

2. The apparatus of claim 1, further comprising a door rotatably connected to the enclosure.

3. The apparatus of claim 2, wherein the door and the frame are positioned on opposite sides of the enclosure.

4. The apparatus of claim 2, wherein the door and the frame are positioned on adjacent sides of the enclosure.

5. The apparatus of claim 1, further comprising a stop member connected to and extending from the enclosure.

6. The apparatus of claim 5, wherein the stop member contacts the frame at a predetermined rotation of the frame about the axis of rotation.

7. The apparatus of claim 1, further comprising a patch panel connected to the frame.

8. The apparatus of claim 7, further comprising a cable manager connected to the frame, wherein the cable manager is positioned adjacent to the patch panel.

9. The apparatus of claim 1, wherein the bracket includes an opening for receiving the cable ring.

10. The apparatus of claim 1, wherein the cable ring includes a D-ring.

* * * * *